US012326152B2

(12) United States Patent
Lazoglu et al.

(10) Patent No.: US 12,326,152 B2
(45) Date of Patent: Jun. 10, 2025

(54) UNIBODY AXIAL PUMP

(71) Applicant: KOC UNIVERSITESI, Istanbul (TR)

(72) Inventors: Ismail Lazoglu, Istanbul (TR); Aamir Shahzad, Istanbul (TR); Shaheryar Atta Khan, Istanbul (TR)

(73) Assignee: KOC UNIVERSITESI, Istanbul (TR)

( * ) Notice: Subject to any disclaimer, the term of this patent is extended or adjusted under 35 U.S.C. 154(b) by 0 days.

(21) Appl. No.: 18/269,560

(22) PCT Filed: Dec. 31, 2020

(86) PCT No.: PCT/TR2020/051474
§ 371 (c)(1),
(2) Date: Jun. 25, 2023

(87) PCT Pub. No.: WO2022/146258
PCT Pub. Date: Jul. 7, 2022

(65) Prior Publication Data

US 2024/0060503 A1 Feb. 22, 2024

(51) Int. Cl.
*F04D 29/18* (2006.01)
*F04D 3/02* (2006.01)

(52) U.S. Cl.
CPC ..... *F04D 29/181* (2013.01); *F04D 3/02* (2013.01)

(58) Field of Classification Search
CPC ..... F04D 29/181; F04D 3/02; F04B 19/12
See application file for complete search history.

(56) References Cited

U.S. PATENT DOCUMENTS

| | | | | |
|---|---|---|---|---|
| 1,613,147 | A * | 1/1927 | Wahlstrom | F04D 3/02 417/257 |
| 5,711,371 | A | 1/1998 | Bingham | |
| 9,814,294 | B2 * | 11/2017 | Hermouet | A45D 40/065 |
| 10,251,985 | B2 * | 4/2019 | Larose | A61M 60/806 |
| 2007/0145855 | A1 * | 6/2007 | Liu | F04D 3/02 310/86 |
| 2017/0204753 | A1 | 7/2017 | Sacomori et al. | |
| 2023/0407867 | A1 * | 12/2023 | Burkitt | F04D 25/0606 |

FOREIGN PATENT DOCUMENTS

| | | | |
|---|---|---|---|
| CN | 111441957 | A | 7/2020 |
| JP | 2003065275 | A | 3/2003 |

* cited by examiner

*Primary Examiner* — Justin D Seabe
*Assistant Examiner* — Jackson N Gillenwaters
(74) *Attorney, Agent, or Firm* — Bayramoglu Law Offices LLC

(57) ABSTRACT

A bladeless impeller and a bladeless axial pump having such an impeller, wherein the impeller has at least one rigid body suitable for rotating around at least one axis of rotation, and at least one helical groove located in the body, forming a passage between two parts of the body.

14 Claims, 4 Drawing Sheets

UNIBODY AXIAL PUMP

CROSS-REFERENCE OF THE RELATED APPLICATION

This application is the national phase entry of International Application No. PCT/TR2020/051474, filed on Dec. 31, 2020, the entire content of which is incorporated herein by reference.

TECHNICAL FIELD

The present invention relates to an axial pump, and especially to a unibody axial pump.

BACKGROUND

Axial flow pumps find vast applications in the pumping of working fluids such as lubricating oil in engines and compressors, and blood in devices such as left ventricular assist devices (LVADs) and extracorporeal membrane oxygenation (ECMO) devices.

Axial flow pumps comprise a propeller (impeller) which is driven by a motor that is sealed. The working fluid flows through a suction hub into the rotating impeller. Blades of the impeller, which are permanently fixed on a shaft, exert a force on the fluid and increase its angular momentum. Losses occurring in the system, for example due to friction or leakage flows, require an increased power consumption. Moreover, impeller blades' wear and bearing maintenance are also major problems associated with the conventional axial pumps. Reducing the cost of mechanical components such as separate housing, blades or the rotating impeller may be the most effective way to make axial flow pumps more favorable and executable, especially for the hermetic reciprocating compressors where sufficient lubrication of the moving parts at low speed is challenging. Additionally, the entrance angle, outlet angle, axial and radial clearances of blades associated with the flow need to be optimized to maintain efficiency of the conventional axial pumps. Yet another problem with the present axial-flow pumps is that conventional axial pumps or screw pumps are not suitable for the lubrication of moving parts of a hermetic reciprocating compressor at low speeds. Also, there is need of fixing the screw part to the housing of the hermetic reciprocating compressor and extreme caution is required for the alignment.

The United States patent application numbered US20170204753 in the state of the art discloses a variable speed cooling compressor including lubricating oil pumping system. In the document, the rotating shaft of the compressor acts as a helical oil pump.

SUMMARY

The objective of the invention is to provide a bladeless impeller.

Another object of the invention is to provide an axial pump having an improved lifespan.

Another objective of the invention is to provide a bladeless axial pump.

BRIEF DESCRIPTION OF THE DRAWINGS

The bladeless impeller and the bladeless axial pump in order to fulfill the objects of the present invention is illustrated in the attached figures, where.

Figure 1:
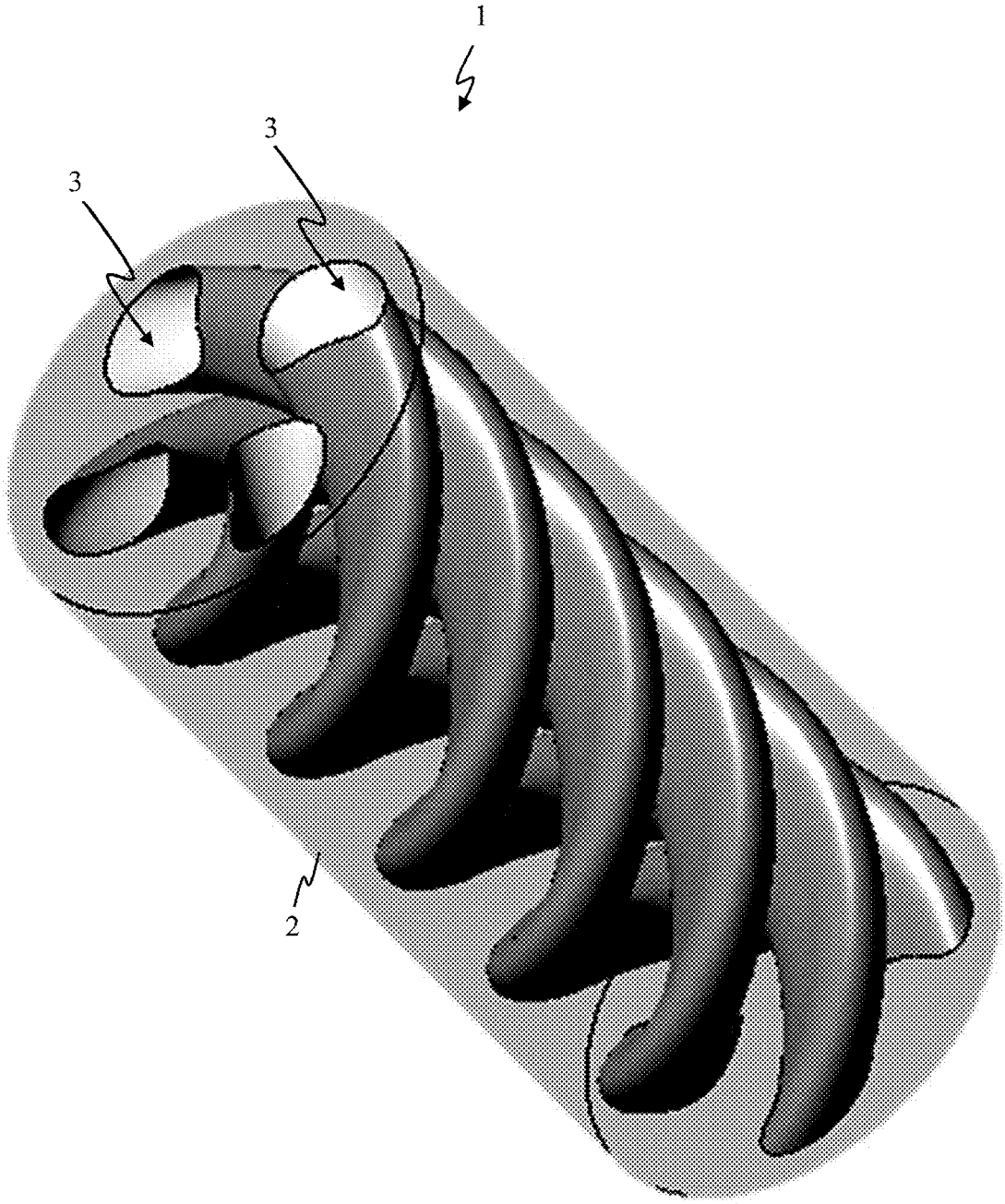
FIG. 1 is a schematic view of the inventive bladeless impeller.

Elements shown in the figures are individually numbered, and the correspondence of these numbers are given as follows:

1. Bladeless impeller
2. Body
3. Groove
10. Pump
11. Housing
12. Inlet opening
13. Outlet opening
14. Cavity

DETAILED DESCRIPTION OF THE EMBODIMENTS

The bladeless impeller (1) comprises;

at least one rigid body (2) suitable for rotating on at least one axis of rotation, and at least one helical groove (3) located in the body (2), forming a passage between two parts of the body.

The bladeless impeller (1) comprises at least one rigid body (2) suitable for rotating around at least one axis or rotation. The body (2) preferably has a cylindrical shape, however it might have a cross section of any shape such as an ellipse or any closed polygonal shape.

The cross-section of the body (2) is preferably uniform throughout an axis. However, this is not mandatory and the cross-section might differ throughout the axis. For example, the body (2) might have a cylindrical cross-section with varying radii throughout the axis. Examples for such cross-sections are circle, ellipse, D-shape and S-Shape, however, the list is not exhaustive. The body (2) might also have a uniform cross-section which rotates throughout the axis thereby forming a twisted body (2). The twisted structure further improves the manipulation of the liquid to be moved.

At least one helical groove (3) is located in the body (2), forming a passage between two ends of the body (2). The cross-section of the groove (2) is preferably uniform throughout a helical line between the two ends of the body (2). However, this is not mandatory and the cross-section might differ throughout the line. For example, the groove (2) might have a cylindrical cross-section with varying radii throughout the axis. Examples for such cross-sections are circle, ellipse, D-shape and S-Shape, however, the list is not exhaustive.

Figure 2:
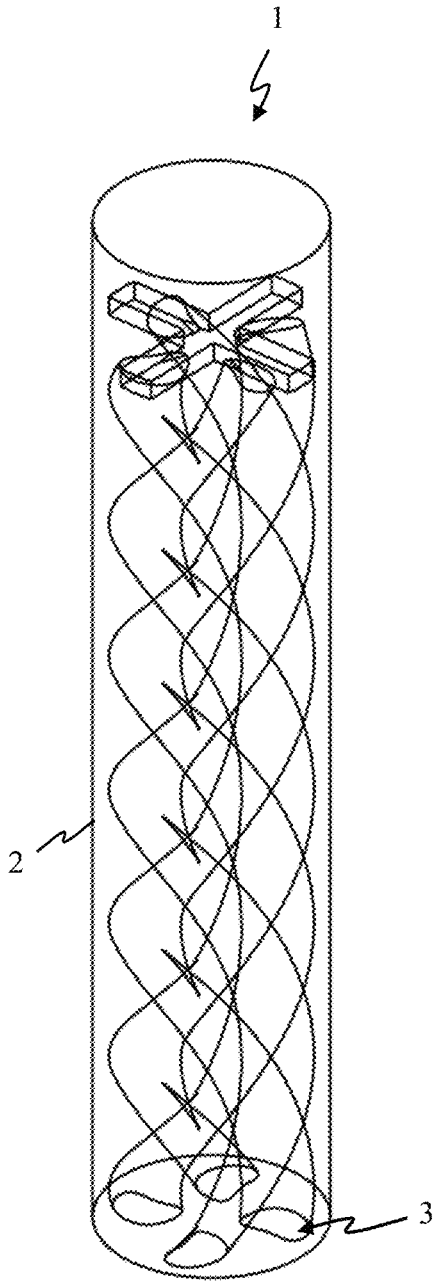
FIG. 2 is a schematic view of the inventive bladeless impeller having a custom outlet portion.
Figure 3:
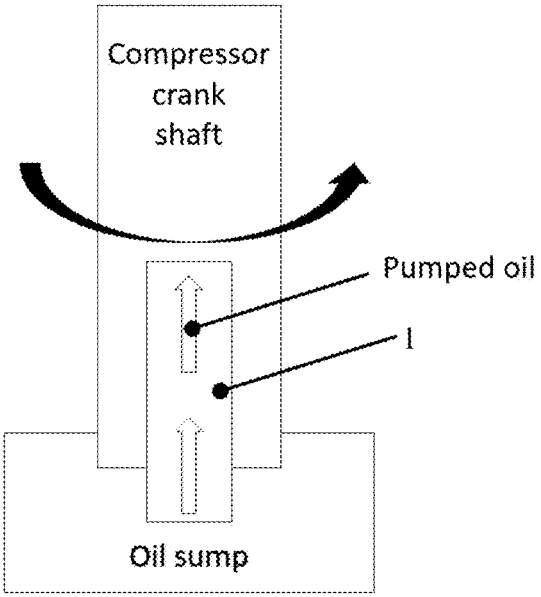
FIG. 3 is an illustration of the direct connection of the bladeless impeller to a rotating shaft.
Figure 4:
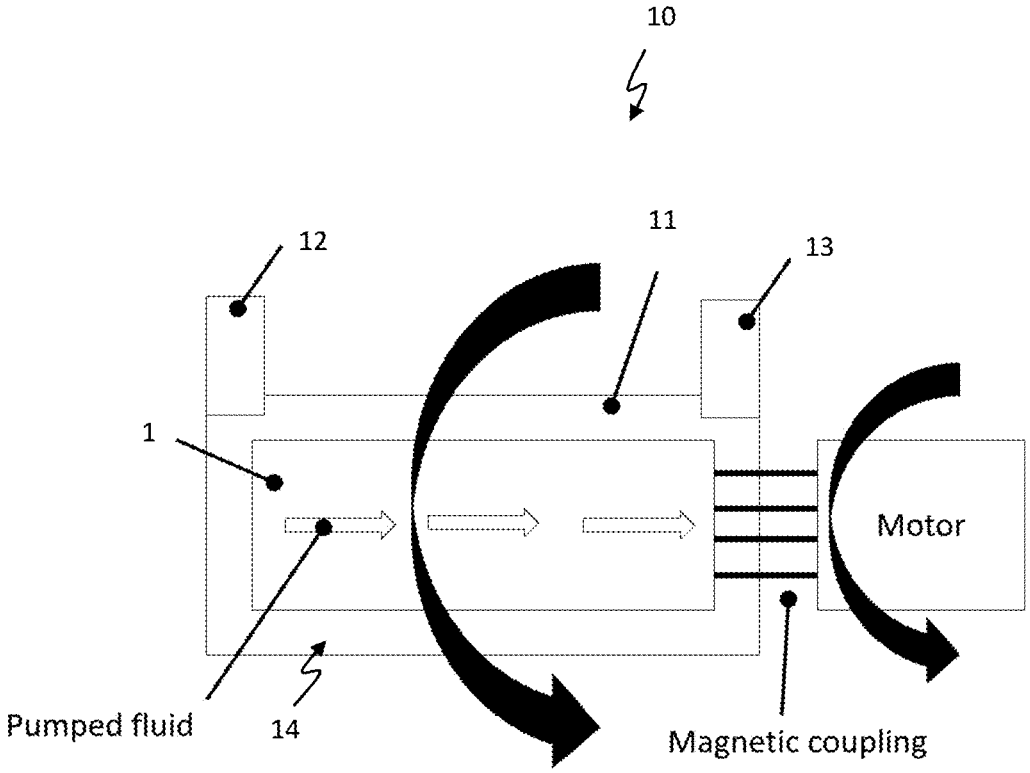
FIG. 4 is a schematic view of the axial pump wherein the connection of the bladeless impeller to a rotating body is realized via the magnetic coupling means.

As explained above, the groove (3) forms a passage between two ends of the body (2). One end of the groove (3) is suitable for a fluid to enter the groove (3). This end is also regarded to as inlet portion of the groove (3). The other end of the groove (3) is suitable for a fluid to leave the groove (3). This end is also regarded to as outlet portion of the groove (3). The outlet portion of the groove might have a customized shape, an example of which is given in FIG. 2. The custom shape enables the direction of the liquid leaving the body (2) to be adjusted. Said custom shape might be any shape enabling the liquid to be directed towards a required direction or towards multiple directions.

During the use of the bladeless impeller (1), the inlet portion of the groove (3) should be submerged into the fluid to be manipulated. Once submerged in the fluid, the rotation of the body (2), and thus the groove (3), causes the fluid to move from the inlet portion towards the outlet portion of the groove (3).

The inventive bladeless impeller (1) might be connected to a rotating shaft, such as a compressor crank shaft, thereby rotating with the rotation of the shaft. In this case, at least the inlet portion of the groove (3) is submerged in the liquid to be moved.

In an embodiment of the invention, the inventive bladeless impeller (1) comprises at least one magnetic coupling means (not shown) enabling the bladeless impeller (1) to be driven via an external magnetic force. The magnetic coupling means may be any material that enables the body (2) to be rotated about a rotation axis, under the influence of an external magnetic field. For example, the external magnetic field might be applied using rotating magnets. The rotating magnets cause the magnetic coupling means, and thus the body (2), to rotate about a rotation axis.

The inventive bladeless impeller (1) might be coupled with a rotating shaft via the magnetic coupling means, thereby rotating with the rotation of the shaft.

The inventive pump (10) comprises at least one housing (11). The housing (11) comprises at least one inlet opening (12) for receiving the fluid to be moved, and at least one outlet opening (13) for discharging the received fluid. The housing (11) comprises at least one cavity (14) connecting the inlet opening (12) and the outlet opening (13) to each other. The cavity (14) is also suitable for the bladeless impeller (1) to be placed and to within. The pump (10) further comprises the bladeless impeller (1) as explained above. The bladeless impeller (1) might be driven via the magnetic coupling means as explained above. Alternatively, the bladeless impeller (1) might be driven via a rotating shaft passing through the housing (11). Once the bladeless impeller (1) starts rotating, it drives the fluid to be moved from the inlet opening (12) to the outlet opening (13).

The invention claimed is:

1. A bladeless impeller, comprising:

a rigid body configured to rotate on at least one axis, and at least one helical groove located in the body, forming a passage between two end surfaces of the body;

wherein the body has a cylindrical shape;

wherein the at least one helical groove is entirely encapsulated within the body except an inlet of the at least one helical groove is exposed at one of the two end surfaces of the body and an outlet of the at least one helical groove is exposed at the other of the two end surfaces of the body; and wherein the inlet and the outlet of the at least one helical groove each exposes at the corresponding end surface of the cylindrical-shaped body without exposing at side surface areas of the cylindrical-shaped body.

2. The bladeless impeller according to claim 1, wherein a cross-section of the body is uniform throughout an axis.

3. The bladeless impeller according to claim 2, wherein a cross-section of the groove is uniform throughout a helical line between the two end surfaces of the body.

4. The bladeless impeller according to claim 2, wherein a cross-section of the groove differs throughout a helical line between the two end surfaces of the body.

5. The bladeless impeller according to claim 1, wherein the body has a cylindrical cross-section with varying radii throughout an axis.

6. The bladeless impeller according to claim 5, wherein a cross-section of the groove is uniform throughout a helical line between the two end surfaces of the body.

7. The bladeless impeller according to claim 5, wherein a cross-section of the groove differs throughout a helical line between the two end surfaces of the body.

8. The bladeless impeller according to claim 1, wherein the body has a uniform cross-section which rotates throughout an axis thereby forming a twisted body.

9. The bladeless impeller according to claim 8, wherein a cross-section of the groove is uniform throughout a helical line between the two end surfaces of the body.

10. The bladeless impeller according to claim 8, wherein a cross-section of the groove differs throughout a helical line between the two end surfaces of the body.

11. The bladeless impeller according to claim 1, wherein a cross-section of the groove is uniform throughout a helical line between the two end surfaces of the body.

12. The bladeless impeller according to claim 1, wherein a cross-section of the groove differs throughout a helical line between the two end surfaces of the body.

13. The bladeless impeller according to claim 1, further comprising at least one magnetic coupling enabling the body to be rotated about the at least one axis under an influence of an external magnetic field.

14. A pump comprising at least one housing, the housing having at least one inlet opening for receiving the fluid to be moved, at least one outlet opening for discharging the received fluid, and at least one cavity connecting the inlet opening and the outlet opening to each other, wherein the at least one cavity is also suitable for a bladeless impeller to be placed and to rotate within, and wherein the pump further comprises the bladeless impeller according to claim 1 inside the at least one cavity.

* * * * *